US005570675A

United States Patent [19]

Treadway

[11] Patent Number: 5,570,675

[45] Date of Patent: Nov. 5, 1996

[54] TAKE-DOWN ARCHERY BOW

[76] Inventor: Michael J. Treadway, 615 Meadows Town Rd., Marshall, N.C. 28753

[21] Appl. No.: 228,644

[22] Filed: Apr. 18, 1994

[51] Int. Cl.[6] ..... F41B 5/00

[52] U.S. Cl. ..... 124/23.1; 124/88; 403/300; 403/306

[58] Field of Search ..... 124/23.1, 24.1, 124/25.6, 86, 88; 403/305, 306, 298, 300

[56] References Cited

U.S. PATENT DOCUMENTS

| | | | |
|---|---|---|---|
| 81,270 | 8/1868 | Good et al. | 403/300 X |
| 540,834 | 6/1895 | Gumm | 403/305 X |
| 1,073,614 | 9/1913 | McDearmid | 403/305 X |
| 1,853,294 | 4/1932 | Barnhart | 124/23.1 |
| 2,228,823 | 1/1941 | Helm | 124/23.1 |
| 2,426,283 | 8/1947 | Pearson | 124/23.1 |
| 2,457,793 | 12/1948 | Bear | 124/23.1 |
| 2,514,638 | 7/1950 | Grenier | 124/23.1 |
| 3,156,230 | 11/1964 | Groves | 124/23.1 |
| 3,415,240 | 12/1968 | Bear | 124/23.1 |
| 3,502,063 | 3/1970 | Bear | 124/23.1 |
| 3,612,028 | 10/1971 | Karbo | 124/24.1 |
| 3,738,348 | 6/1973 | Karbo | 124/24.1 |
| 3,814,075 | 6/1974 | Hoyt | 124/24.1 |
| 3,921,598 | 11/1975 | Helmick | 124/24.1 |
| 3,957,027 | 5/1976 | Drake | 124/23.1 |
| 4,290,710 | 9/1981 | Waller | 403/306 |
| 4,574,766 | 3/1986 | Izuta | 124/23.1 |
| 4,674,468 | 6/1987 | Izuta | 124/23.1 |
| 5,025,774 | 6/1991 | Martin | 124/88 X |
| 5,037,234 | 8/1991 | De Jong | 403/298 X |
| 5,291,874 | 3/1994 | Harrison | 124/23.1 |

FOREIGN PATENT DOCUMENTS

| | | | |
|---|---|---|---|
| 747692 | 12/1966 | Canada | 124/23.1 |
| 75413 | 7/1918 | France | 403/306 |
| 1022401 | 3/1953 | France | 124/23.1 |
| 635439 | 4/1950 | United Kingdom | 403/306 |
| 1430790 | 4/1976 | United Kingdom | 403/300 |

*Primary Examiner*—John A. Ricci
*Attorney, Agent, or Firm*—Joseph T. Guy, Jr.

[57] ABSTRACT

A improved take-down archery bow is detailed which is easily taken apart, does not require excessive tools, and has the advantage of being useful in existing bows. These and other advantages are provided in a take-down archery bow comprising: a first elongated limb and second elongated limb each comprising a string attached on one end and matching abutment joint opposite thereto; a first assembly mechanism attached to the abutment joint of the first elongated limb comprising an alignment post parallel to the first elongated limb; a second assembly mechanism attached to the abutment joint of the second elongated limb comprises an alignment bore parallel to the second elongated limb capable of receiving the alignment post and aligning the matching abutment joints; an attachment plate rigidly attached to the back of one elongated limb and removable attached to the back of the other elongated limb.

11 Claims, 2 Drawing Sheets

TAKE-DOWN ARCHERY BOW

FIELD OF THE INVENTION

This invention relates to an archery bow which can be easily taken apart for storage and transport, More specifically this invention relates to an archery bow which has an improved method of attaching the limbs allowing for rapidly dismantling of the archery bow without sacrificing strength or shooting accuracy,

BACKGROUND OF THE INVENTION

Archery has long been of interest for shooting both wild game and targets. Avid archers must often transport their bow in a vehicle which has created a desire for a bow which can be disassembled rapidly and easily for storage or transport. Many archery bows have been described which can be disassembled into three parts as exemplified in U.S. Pat. Nos. 4,674,468; 4,574,766; 3,957,027; 3,415,240; 3,921,598; 3,814,075 and 3,502,063. These all require two limbs to be engaged with a handle. The extra time required for assembly is detrimental. Another disadvantage with the three piece bows is the criticality of the joint. Since the handle does not flex appreciably in the three piece designs the entire shooting action of the bow is dependent on the outer extent of the limbs. Even slight differences in the mounting of the two limbs may cause the bow to lose accuracy.

Two piece designs have been detailed in U.S. Pat. Nos. 3,738,348; 3,612,028 and 3,156,230. These are also deficient for various reasons. An asymmetrical bow, as detailed in U.S. Pat. No. 3,156,230 suffers from the potential for poor accuracy. The flexing of the two limbs may be different which could alter the flight of the arrow and the accuracy of shooting. Furthermore, the handle must be large to provide a large surface area for the abutment. A biased cut places pressure on the back of the cut when the arrow is drawn and this pressure is transferred to the front of the cut when the arrow is released. A bias cut necessarily comprises an acute angle on one piece of the joint and an acute angle is potentially weaker than a right angle.

U.S. Pat. No. 3,738,348 comprises stepped interior ends. Upon drawing the arrow the rotational force places a considerable strain on the interengaging ramps which causes wear and the potential for fatigue fractures. Furthermore, the manufacture of archery bows with the interengaging ramps is more expensive and the cost of the finished product may be prohibitive. Fitting of existing bows with the interengaging ramps would be difficult.

U.S. Pat. No. 3,612,028 comprises a hinge which allows the two limbs to be folded. The plane of force applied when the arrow is drawn is perpendicular to the axle of the hinge. Any slack in the axle of the hinge could cause the limbs to vibrate which could affect the accuracy of the arrow. If the axle is tight the bow is difficult to fold. The axle can be properly fit during manufacture but any wear will create a bow which could vibrate or lose accuracy. Furthermore, the hinge adds complexity, and associated cost, to the manufacturing process.

There has been a long felt need in the art for an archery bow which can be disassembled into two parts yet maintain accuracy over a long period of time.

SUMMARY OF THE INVENTION

It is an object of the present invention to provide a take-down archery bow which can be dismantled without sacrificing strength or shooting accuracy.

It is another object of the present invention to provide a take-down bow which is easily dismantled.

It is yet another object of the present invention to provide a take-down bow which can be manufactured as such.

It is another object of the present invention to provide an assembly which can be installed on a previously constructed bow.

These and other advantages, as will be apparent from the description, are provided in a take-down archery bow comprising:

- a first elongated limb and second elongated limb each comprising a string attachment means on one end and matching abutment joint opposite thereto;
- a first assembly mechanism attached to said abutment joint of said first elongated limb comprising an alignment post parallel to said first elongated limb;
- a second assembly mechanism attached to said abutment joint of said second elongated limb comprises an alignment bore parallel to said second elongated limb capable of receiving said alignment post and aligning said matching abutment joints;
- an attachment plate rigidly attached to the back of one said elongated limb and removable attached to the back of the other said elongated limb.

A particularly preferred embodiment is provided in a take-down archery bow comprising:

- a first elongated limb and second elongated limb each comprising a string attachment means on one end and matching abutment joint opposite thereto;
- a first assembly mechanism attached to said abutment joint of said first elongated limb comprising an alignment guide;
- a second assembly mechanism attached to said abutment joint of said second elongated limb comprises an alignment guide receiver capable of receiving said alignment guide and aligning said matching abutment joints;
- an attachment plate rigidly attached to the back of one said elongated limb and removable attached to the back of other said elongated limb.

A preferred method for constructing the inventive take-down archery bow is provided in a method for forming a take-down archery bow comprising the steps of:

(a) cutting an archery bow into two equal lengths thereby forming a first joint face and a second joint face;

(b) securing an alignment post to said first joint face;

(c) forming an alignment bore in said second joint face such that when said alignment post is inserted in said alignment bore said first joint face and said second joint face are aligned;

(d) attaching a plate to the back of said take-down archery bow such that said plate contacts each said equal length.

DETAILED DESCRIPTION OF THE INVENTION

Throughout the following description similar elements are numbered accordingly.

Figure 1:
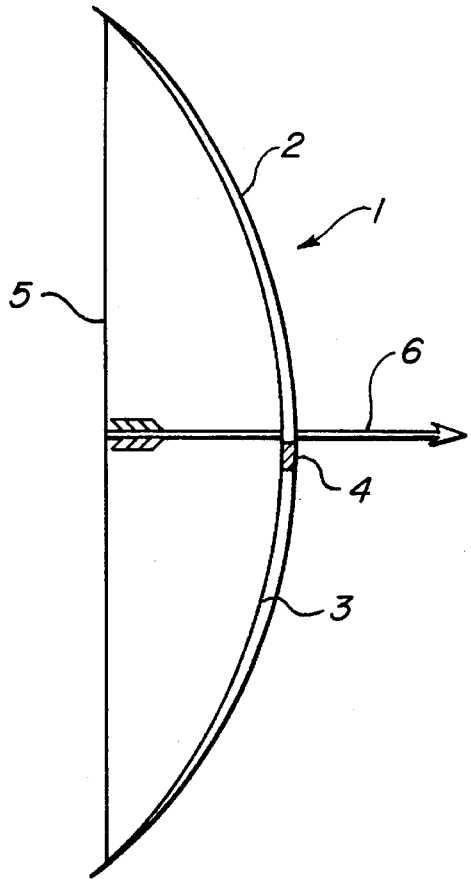
FIG. 1 PRIOR ART
FIG. 1 illustrates a conventional archery bow.

FIG. 1 shows a conventional archery bow generally indicated by 1. The bow is a single piece comprising an upper portion, 2, a lower portion, 3, and a handle, 4, attached therebetween. A string, 5, attaches to notches in the upper portion and lower portion thereby placing the bow under stress to form an arch as known in the art. An arrow, 6, connects to the string. When drawn the arrow lies along the vector which is at or slightly above the center of the archery bow. The arrow may lie along a vector which is several inches above the center in some cases but less than 2 inches is common. The belly of the archery bow is defined as the side closest to the string and the back is defined as the side away from the string.

Figure 2:
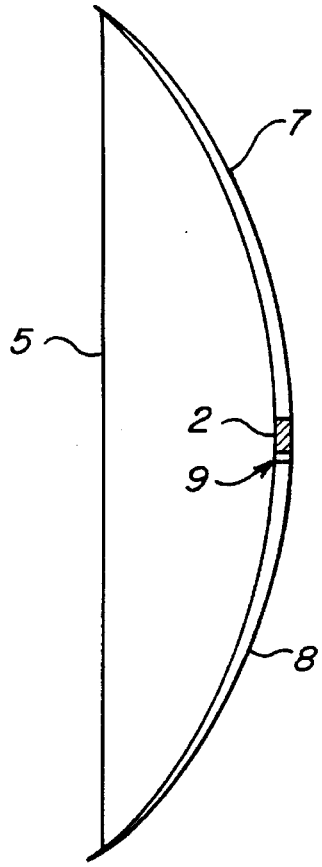
FIG. 2 illustrates a take-down archery bow of the present invention.

FIG. 2 shows a take-down archery bow of the present invention. In FIG. 2 the removable upper limb, 7, and removable lower limb, 8, are attached at a joint generally indicated by 9. The joint is illustrated in more detail in FIGS. 3 and 4.

Figure 3:
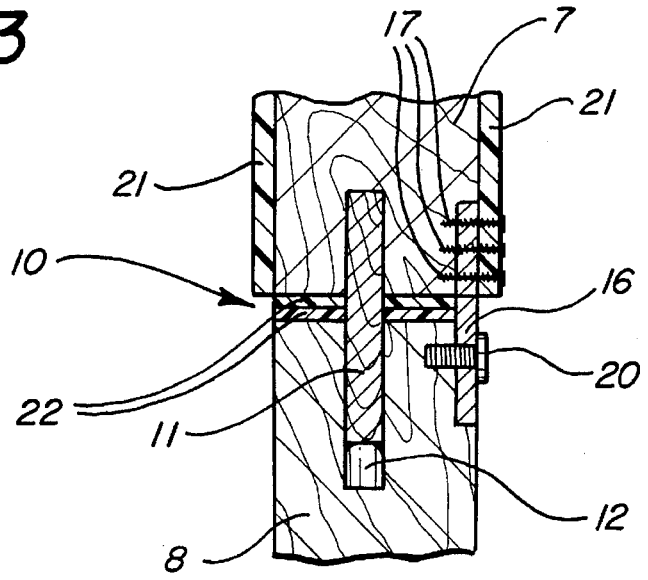
FIG. 3 illustrates the joint mechanism of a take-down archery bow of the present invention with the limbs joined for archery.
Figure 4:
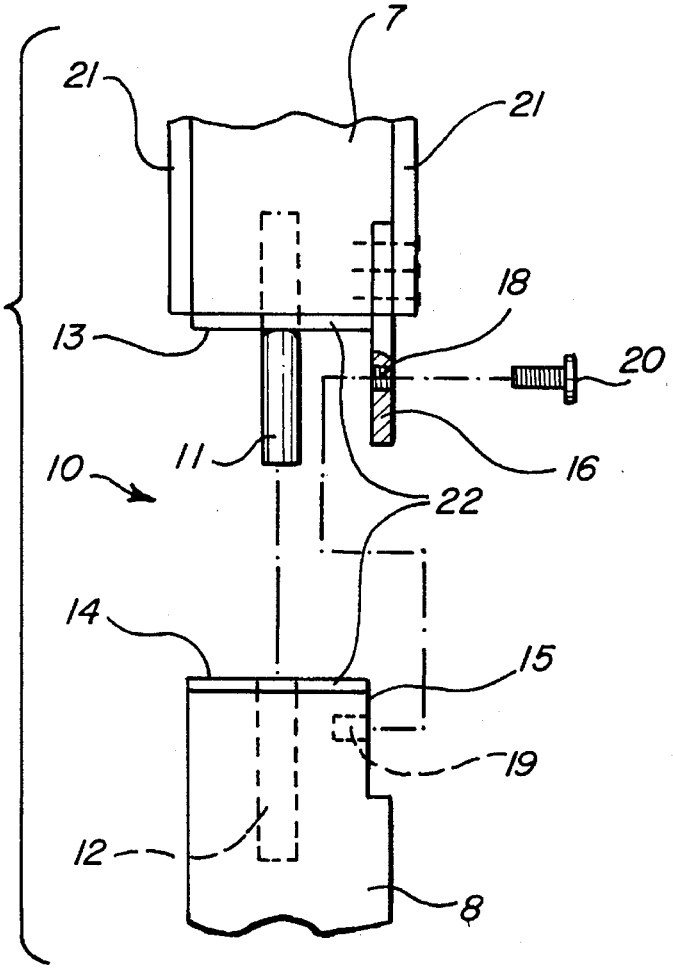
FIG. 4 illustrates an exploded view of the take-down archery bow of the present invention.

The joint of the present invention is shown assembled in FIG. 3 and an exploded view is provided in FIG. 4. The removable upper limb, 7, and removable lower limb, 8, abut at the seam, 10. An alignment guide, 11, is rigidly mounted in either limb and removably inserts into a matching cavity, 12, of the other limb. For purpose of illustration the alignment guide is rigidly mounted to the removable upper limb and the matching cavity is in the removable lower limb in the figures. It would be apparent that this is a design choice and could be reversed without departing from the spirit or scope of the invention. The alignment guide, 11, and matching cavity, 12, insure proper alignment of the upper abutment face, 13, with the lower abutment face, 14. The removable lower limb, 8, comprises an optional recess, 15, for receiving a rigid attachment plate, 16. The optional recess allows the exterior surface of the bow to be relatively smooth without protrusion of the attachment plate. The attachment plate, 16, is permanently mounted to the removable upper limb, 7, by a multiplicity of screws, 17. A bore, 18, in the attachment plate, 16, aligns with a threaded bore, 19, in the removable lower limb, 8, when the abutment faces are in intimate contact. A threaded bolt, 20, is inserted through the bore of the attachment plate and is rotationaly engaged with the threaded bore thereby securing the attachment plate, 16, to the recess of the removable lower limb, 8. A handle, 21, wraps around the portion of the removable upper limb thereby covering that portion of the attachment plate which is permanently attached to the removable upper limb. Each abutment face comprises an optional, yet preferred, washer, 22, to insure integrity of the mating surfaces. A Teflon® washer is most preferred.

Many suitable materials of construction for the limbs are known in the art. Specifically mentioned are solid wood or plastic or a laminate comprising combinations of wood and plastic. Most preferably, the archery bow is constructed as a single piece and cut into two parts prior to structural detailing. Prior to structural detailing the construction is known as a "blank" and the faces are substantially perpendicular. It is preferable to cut the blank since most archery bows are custom made to include various curvatures and cross-sectional shapes and the curvature inhibits the ability of the craftsman to insure a cut which is perpendicular to all faces of the archery bow. Finished archery bows may receive the mounting apparatus but it is recommended that care be taken to insure the cut is perpendicular to the back and side surfaces of the archery bow.

The limbs of the archery bow may be relatively straight when the strings are removed as is common with a long bow or they may have one or more radii of curvature as common in a recurve bow without departing from the scope and spirit of the present invention.

The preferred alignment guide is a rod, or post, as described herein. Other guides may be mentioned as known in the art including rabbit joints, tongue-groove joints and the like. The rod is preferred due to the ease of manufacture.

The attachment plate is preferably made of metal. It would be apparent from the disclosure that one advantage of the inventive archery bow is that the distribution of force is parallel to the attachment means as desirable.

It should be appreciated that the threaded bore and matching cavity may comprise a sleeve to insure accurate mating without departing from the invention.

Claimed is:

1. A take-down archery bow comprising:

a first elongated limb and second elongated limb each comprising a string attachment means on one end and matching abutment joint opposite thereto;

a first assembly mechanism attached to said abutment joint of said first elongated limb comprising an alignment post parallel to said first elongated limb;

a second assembly mechanism attached to said abutment joint of said second elongated limb comprising an alignment bore parallel to said second elongated limb capable of receiving said alignment post and aligning said matching abutment joints;

an attachment plate rigidly attached to the back of one said elongated limb and removably attached to the back of the other said elongated limb.

2. The take-down archery bow of claim 1 wherein at least one said elongated limb comprises a recess for receiving said attachment plate.

3. The take-down archery bow of claim 1 wherein said abutment joint comprises a washer.

4. The take-down archery bow of claim 1 wherein said first elongated limb and said second elongated limb each comprise a long axis and a short axis and said matching abutment joints are perpendicular to said long axis.

5. A take-down archery bow comprising:

a first elongated limb and second elongated limb each comprising a string attachment means on one end and matching abutment joint opposite thereto;

a first assembly mechanism attached to said abutment joint of said first elongated limb comprising an alignment guide;

a second assembly mechanism attached to said abutment joint of said second elongated limb comprising an alignment guide receiver capable of receiving said alignment guide and aligning said matching abutment joints; an attachment plate rigidly attached to the back of one said elongated limb and removably attached to the back of the other said elongated limb; and wherein at least one said elongated limb comprises a recess for receiving said attachment plate.

6. The take-down archery bow of claim 5 wherein said alignment guide is a post parallel to said first elongate limb and said alignment guide receiver is a bore.

7. The take-down archery bow of claim 5 wherein each said abutment joint comprises a washer.

8. A method for forming a take-down archery bow comprising the steps of:

(a) cutting an archery bow into two lengths thereby forming a first joint face and a second joint face;

(b) securing an alignment post to said first joint face;

(c) forming an alignment bore in said second joint face such that when said alignment post is inserted in said alignment bore said first joint face and said second joint face are aligned;

(d) attaching a plate to the back of said take-down archery bow such that said plate contacts each said length.

9. The method for forming a take-down archery bow of claim 8 further comprising the step of attaching a washer to at least one of said first joint face and second joint face.

10. The method for forming a take-down archery bow of claim 8 wherein said plate is permanently attached to one said length.

11. The method for forming a take-down archery bow of claim 10 wherein said plate is reversibly attached to one said length.

* * * * *